US007721536B2

(12) United States Patent
Bradley et al.

(10) Patent No.: US 7,721,536 B2
(45) Date of Patent: May 25, 2010

(54) PARTICULATE FILTER HAVING EXPANSIBLE CAPTURE STRUCTURE FOR PARTICULATE REMOVAL

(75) Inventors: James C. Bradley, New Haven, IN (US); Rodney J. Klinger, Fort Wayne, IN (US); Joseph T. Penaloza, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 455 days.

(21) Appl. No.: 11/750,481

(22) Filed: May 18, 2007

(65) Prior Publication Data

US 2008/0282669 A1 Nov. 20, 2008

(51) Int. Cl.
*F01N 3/00* (2006.01)

(52) U.S. Cl. ..... 60/295; 60/274; 60/275; 60/287; 60/293; 60/296; 60/311; 55/282.2; 55/282.3; 55/286; 55/484; 55/525; 55/DIG. 30

(58) Field of Classification Search ..... 60/274, 60/275, 287, 289, 292, 293, 295, 296, 311; 55/282, 282.3, 282.4, 286, 287, 302, 484, 55/525, DIG. 30, 282.2
See application file for complete search history.

(56) References Cited

U.S. PATENT DOCUMENTS

| | | | | |
|---|---|---|---|---|
| 4,296,080 | A | 10/1981 | Rosensweig | |
| 4,346,557 | A * | 8/1982 | Shadman et al. | 60/311 |
| 5,065,574 | A * | 11/1991 | Bailey | 60/274 |
| 5,251,564 | A * | 10/1993 | Rim et al. | 110/344 |
| 5,489,319 | A * | 2/1996 | Tokuda et al. | 96/400 |
| 6,375,695 | B2 * | 4/2002 | Machida et al. | 55/282.3 |
| 6,534,021 | B1 * | 3/2003 | Maus | 422/180 |
| 7,083,663 | B2 * | 8/2006 | Shih et al. | 95/283 |

* cited by examiner

*Primary Examiner*—Binh Q Tran
(74) *Attorney, Agent, or Firm*—Jeffrey P. Calfa; Mark C. Bach

(57) ABSTRACT

A combustion engine comprising an exhaust system containing a particulate filter (10, 52) for trapping particulate matter in engine exhaust passing through the exhaust system. A particulate trapping medium (18) inside a casing is selectively operable to a relatively lesser porosity for trapping particulate matter in the exhaust and to a relatively greater porosity for facilitating removal of trapped particulate matter during cleaning.

15 Claims, 5 Drawing Sheets

PARTICULATE FILTER HAVING EXPANSIBLE CAPTURE STRUCTURE FOR PARTICULATE REMOVAL

FIELD OF THE INVENTION

This invention relates generally to particulate filters, especially those that are used to trap particulate matter in engine exhaust, and to systems and methods for removing trapped particulates.

BACKGROUND OF THE INVENTION

A known system for treating exhaust gas passing through an exhaust system of a diesel engine comprises a diesel oxidation catalyst (DOC) associated with a diesel particulate filter (DPF). The combination of these two exhaust gas treatment devices promotes chemical reactions in exhaust gas and traps diesel particulate matter (DPM) as exhaust flows through the exhaust system from the engine, thereby preventing significant amounts of pollutants such as hydrocarbons, carbon monoxide, soot, SOF, and ash, from entering the atmosphere.

While an engine is running, the existence of certain conditions enables regeneration of a DPF to be initiated. Various techniques are available for developing temperatures sufficiently high to initiate regeneration and thereafter control on-going regeneration. Regeneration is essentially a chemical process that cleans a DPF by burning off trapped DPM. For any of various reasons, not all trapped DPM may be burned off by regeneration. Moreover, the burning of trapped DPM may contribute to the build-up of ash, a non-combustible particulate.

Consequently, it may be either necessary or desirable to occasionally use a physical or mechanical process, rather than a chemical process, to remove particulate matter, such as DPM and/or ash, from a DPF. The use of compressed air has been proposed as one way to remove the particulate matter.

Compressed air is an appropriate medium because it is readily available in service facilities and shops and it is environmentally friendly. Cleaning a DPF by compressed air has involved certain manual operations such as removing the actual filter module from a casing and manually manipulating a compressed air nozzle across a face of the module. Dislodged matter is ejected from an opposite face and collected in some type of collector for subsequent disposal.

When a DPF has been used to an extent where regeneration and mechanical cleaning are unable to sufficiently clean it, it must be replaced.

In light of this background, it is believed that improvements in the mechanical cleaning of diesel particulate filters would enjoy commercial acceptance. For example, a cleaning device and method that would minimize the amount of labor required would be beneficial. Likewise, a device and method that could clean a diesel particulate filter more thoroughly and that could extend the useful life of the filter would be desirable. The ability to satisfactorily clean a diesel particulate filter without having to remove the actual filter module from its casing also would have obvious advantages.

An improvement that would allow an engine to keep running with the exhaust treatment system remaining effective to trap DPM during on-going mechanical cleaning could also be considered desirable.

SUMMARY OF THE INVENTION

The present invention relates to a system and method for mechanically removing particulate matter that has been trapped by a particulate filter through which engine exhaust has passed before entering the surrounding atmosphere.

One general aspect of the invention relates to a combustion engine that when running generates exhaust containing particulate matter and that comprises an exhaust system containing a particulate filter that traps particulate matter in exhaust passing through the exhaust system. The particulate filter comprising a particulate trapping medium that when the engine is running has a relatively lesser porosity for trapping particulate matter in exhaust, and that is operable to have a relatively greater porosity for facilitating mechanical removal of trapped particulate matter.

A further aspect relates to a method for trapping particulate matter entrained in exhaust generated by a combustion engine and for removing trapped particulate matter. The method comprises, when the engine is running, operating a particulate trapping medium to a condition of relatively lesser porosity to trap particulate matter in exhaust flowing through the medium, and when the medium needs to be mechanically cleaned, operating the particulate trapping medium to a condition of relatively greater porosity to allow trapped particulate matter to be removed mechanically from the medium. Cleaning can be performed with the engine off, or in accordance with a still further aspect of the invention while the engine continues running.

According to that still further aspect, a combustion engine comprises an exhaust system containing particulate filters in parallel flow relationship. Each particulate filter comprises a casing containing a medium for trapping particulate matter in engine exhaust passing through the exhaust system. A valve is used for shutting off exhaust to one of the particulate filters while the engine is running. A particulate collector is communicated to the casing of the one particulate filter. A compressed air source delivers compressed air into the casing of the one particulate filter and through its medium to the particulate collector to entrain trapped particulates in the air flow and deposit the entrained particulates in the collector.

The foregoing, along with further aspects, features, and advantages of the invention, will be seen in the following disclosure of a presently preferred embodiment of the invention depicting the best mode contemplated at this time for carrying out the invention. The disclosure includes drawings, briefly described as follows.

DESCRIPTION OF THE PREFERRED EMBODIMENT

Figure 1:
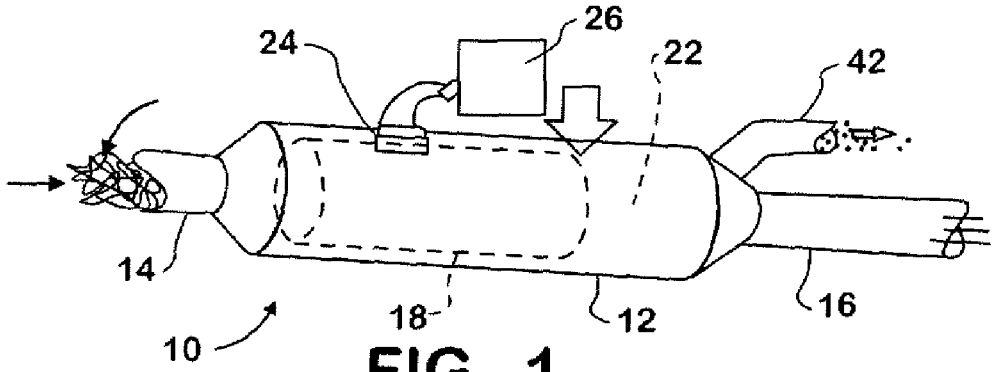
FIG. 1 is a perspective view illustrating a particulate filter embodying principles of the present invention.

FIG. 1 shows a particulate filter 10 suitable for placement in an engine exhaust system for trapping diesel particulate matter in exhaust passing through the filter. Filter 10 comprises a casing 12 having an exhaust inlet 14 through which exhaust enters and an exhaust outlet 16 through which exhaust exits. A particulate trapping medium 18 is disposed within the interior of casing 12 between inlet 14 and outlet 16. As exhaust passes through medium 18, the medium traps diesel particulate matter (DPM) when in a relatively less porous condition shown in FIG. 2 where the DPM is marked by the reference numeral 20. The relatively lesser porosity condition allows exhaust gas, and some DPM having sizes smaller than the porosity of the medium, to pass through to outlet 16 and then into the surrounding atmosphere.

Figure 2:
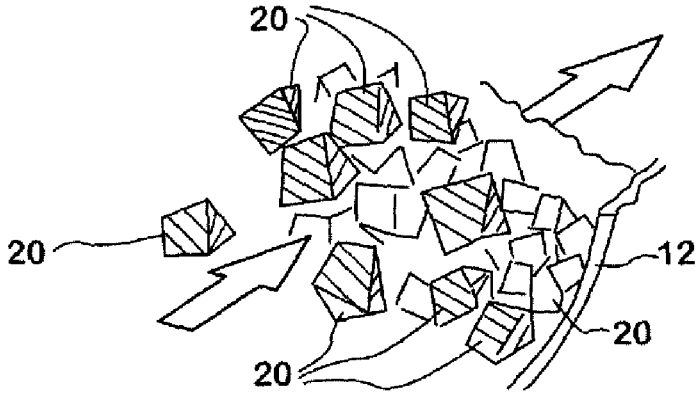
FIG. 2 is an enlarged fragmentary perspective view of a particulate trapping medium inside the filter showing a condition of relatively lesser porosity.
Figure 3:
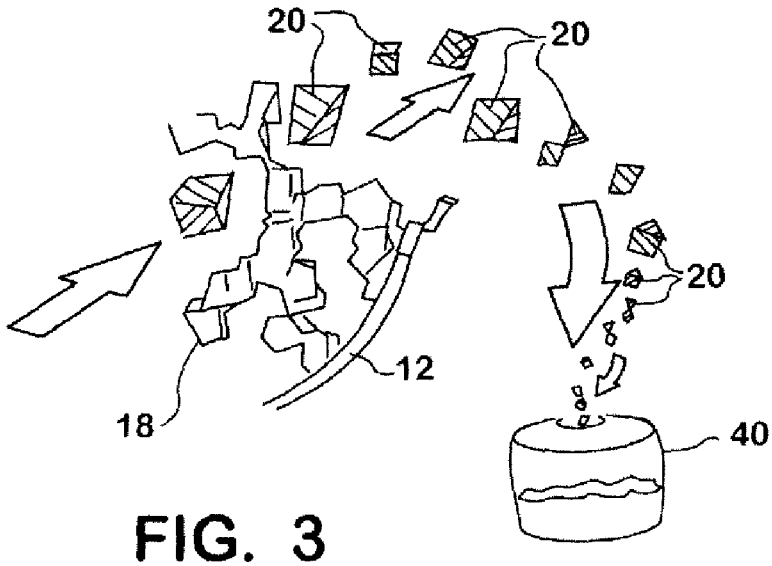
FIG. 3 is an enlarged fragmentary perspective view of a particulate trapping medium showing a condition of relatively greater porosity and removal of trapped particulate matter.

Medium 18 is constructed to be expansible and contractible so as to vary its porosity. A condition of relatively greater porosity is shown in FIG. 3. The material forming medium 18 provides interstices whose sizes and shapes change depending on the extent to which the medium is expanded or contracted. When the medium is maximally contracted, the interstices are relatively smaller and create more tortuous paths for the exhaust gas as it flows through the medium, thereby trapping particulate matter. When the medium is maximally contracted as shown by FIGS. 1 and 2, it has an overall length less than that of casing 12 thereby leaving an interior void 22 inside casing 12 between the medium and exhaust outlet 16 into which the medium can expand.

Medium 18 is constructed to selectively expand and contract as a function of a magnetic field applied to it. An electromagnetic device 24 is disposed in association with medium 18 to provide the magnetic field. Device 24 has a bi-directional capability for selectively creating opposite magnetic fields, one of which is effective to contract medium 18 to relatively lesser porosity and the other of which is effective to expand the medium to relatively greater porosity. If the medium possesses elasticity, then device 24 need have only uni-directional capability.

One example of a trapping medium comprises a multitude of strands or filaments arranged in random and/or ordered pattern. The material of those elements may be chosen to be magnetically responsive to the applied magnetic field. If the material is not so chosen, then the elements may be attached to one or more magnetically responsive pieces that are arranged to move within casing 12 in response to the applied magnetic field and either expand or contact the medium in the process by virtue of suitable attachment to the elements. For instance, application of a certain magnetic field may cause a magnetically responsive piece to pull on ends of elements that are attached to it while opposite ends remain anchored. In the absence of any resiliency, an opposite field may be used to restore the elements to their prior condition. Because magnetic properties of certain materials are temperature-dependent, it may not be possible to use a magnetic field to change the porosity of medium 18 when the particulate filter is hot.

A control system 26 controls the application of electric current to device 24 selectively to cause medium 18 to selectively expand and contract. A strategy 28 for control of the current is shown in FIG. 4.

In a motor vehicle, an engine 30 whose exhaust system contains filter 10 consumes fuel supplied from a tank 32. Exhaust 34 resulting from combustion of fuel in the engine passes through the exhaust system where DPM is captured by a particulate capture device, namely filter 10. The filter is in a relatively lesser porosity condition when the engine runs. A particulate sensor 36 is disposed to sense the extent to which the filter is loaded with DPM. This can be done by measuring exhaust back-pressure on the running engine in relation to engine speed.

When the loading is indicated sufficiently great that mechanical removal of DPM is needed, the engine is shut off, and it and the exhaust system are allowed to cool. Electromagnetic device 24 can then be operated to expand medium 18 to a greater porosity condition. Compressed air from a source of compressed air 38 is introduced into casing 12 upstream of medium 18 and flowed to a collector 40 that is communicated to the downstream side of the medium, such as via a separate outlet 42. Trapped DPM entrains with the air flow and is carried into the collector.

Figure 4:
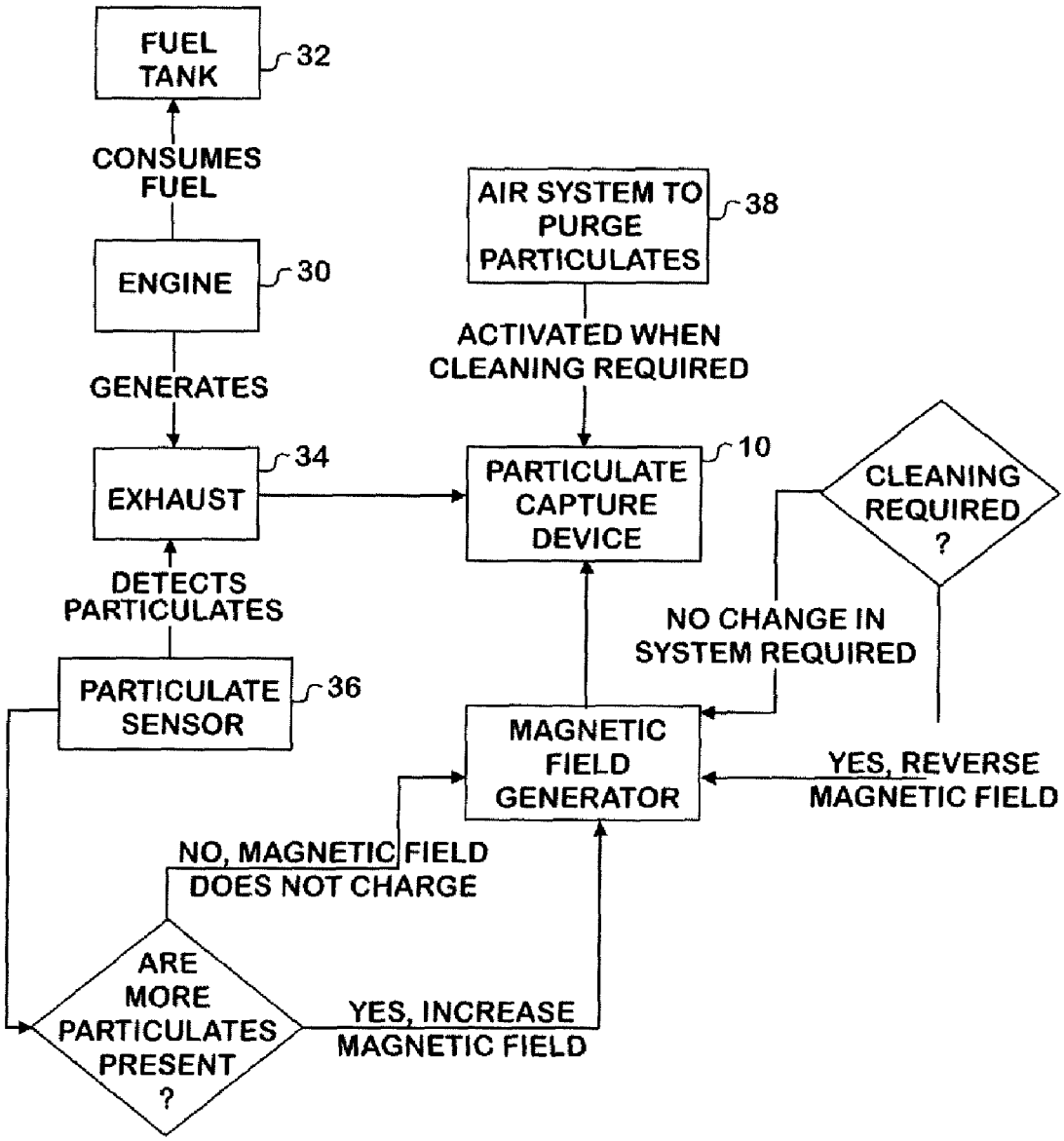
FIG. 4 is a strategy diagram showing steps for operating the filter to the respective conditions.

The remainder of FIG. 4 shows how the magnetic field is adjusted as DPM removal proceeds.

Figure 5:
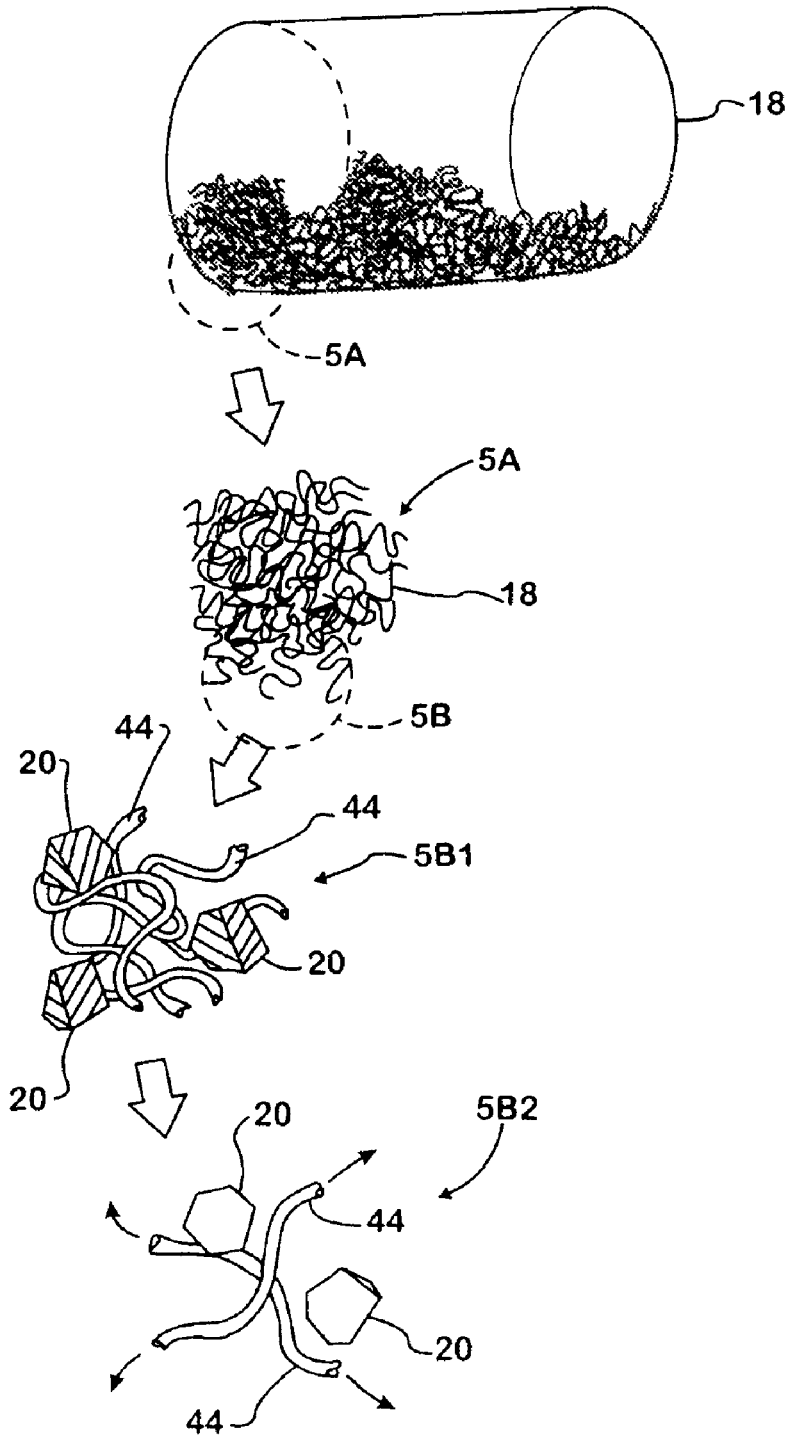
FIG. 5 is a perspective pictorial of a further embodiment in various degrees of detail.

FIG. 5 shows another embodiment of medium 18 that comprises a random pattern of elements 44. Like the prior embodiment, the one shown in FIG. 5 is selectively operable to conditions of relatively greater and relatively lesser porosity. Elements 44 are metal filaments containing various kinks similar to what is commonly known as steel wool although the material of the elements is one that is suited for high temperatures. Rather than using a magnetic field to change the porosity of the medium, the embodiment of FIG. 5 uses an electric field. By suitably connecting elements 44 to respective electrodes (not shown), and applying a potential difference across the electrodes, the kinking can be reduced, making the elements relatively straighter and increasing the porosity of the medium in the process.

In FIG. 5, the reference 5A shows enlarged detail of a portion of the medium while the reference 5B1 is rescaled even larger to show a condition of relatively lesser porosity. The reference 5B2 is on the same scale as that of 5B2, but shows a condition of relatively greater porosity.

Figure 6:
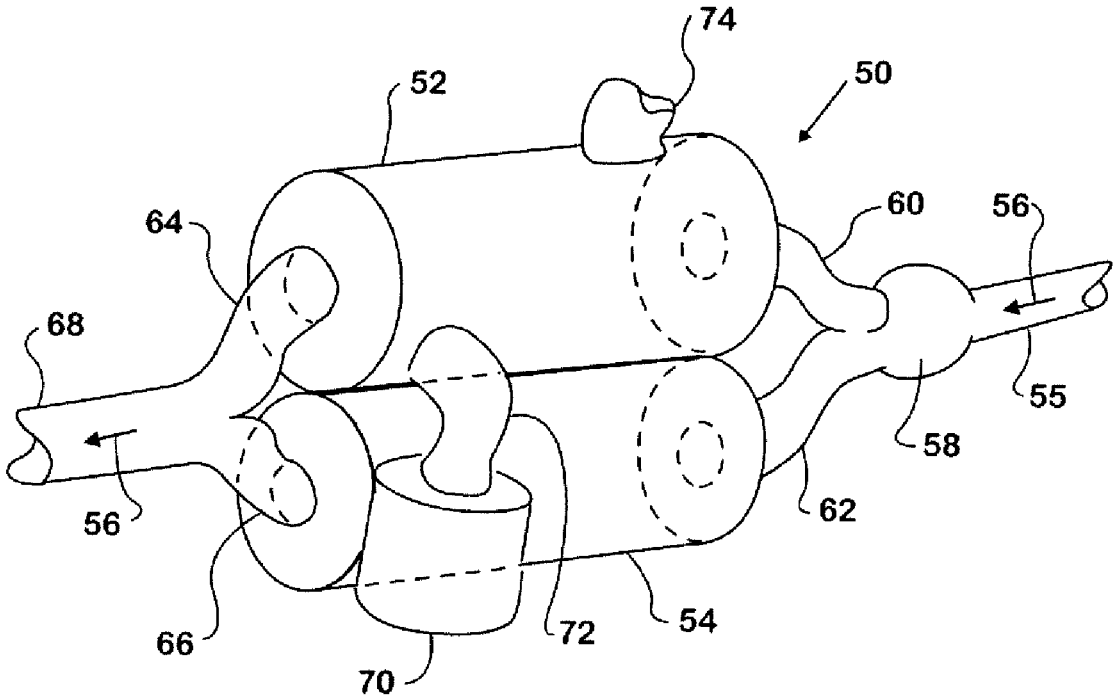
FIGS. 6, 7, and 8 disclose an embodiment of exhaust filter system.
Figure 7:
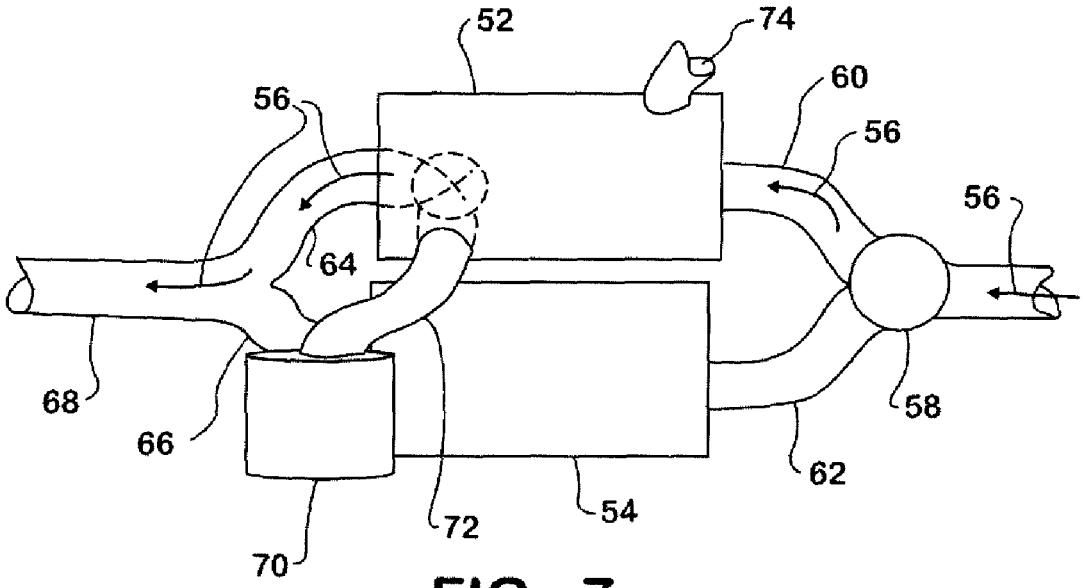
Figure 8:
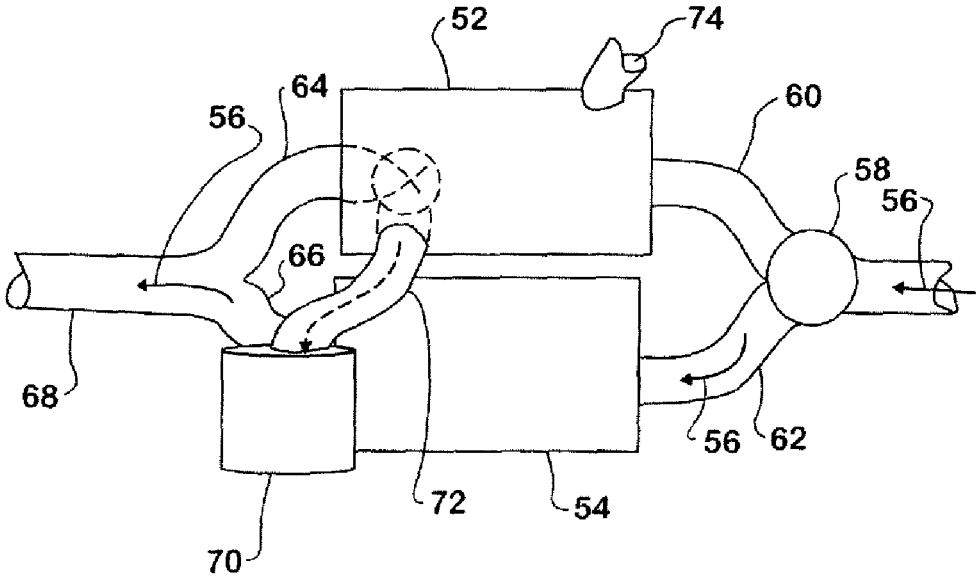

FIGS. 6, 7, and 8 disclose an embodiment of exhaust filter system 50 that utilizes any medium 18 that is selectively operable to relatively greater and relatively lesser porosities. System 50 comprises two chambers 52, 54 that are arranged in parallel flow configuration. Engine exhaust enters through an inlet pipe 55 with flow in the direction of arrows 56. A valve 58 is selectively operable to direct the entering flow to chambers 52, 54 depending on whether system 50 is to assume a principal DPM capture mode or an auxiliary DPM capture mode that allows chamber 52 to be cleaned.

In the principal capture mode, valve 58 directs exhaust to flow via a pipe 60 into chamber 52 where it is filtered by the medium 18 that is inside chamber 52. In the auxiliary capture mode, valve 58 directs the flow into chamber 54 through a pipe 62 instead of into chamber 52. In the principal capture mode, DPM is trapped in medium 18 inside chamber 52, with treated exhaust exiting through a pipe 64 leading to a tailpipe 68.

A collector container 70 is associated with chamber 52 by having an entrance communicated to the interior of chamber 52 via a pipe 72. Another pipe 74 is communicated to the interior of chamber 52 upstream of the location of pipe 72. Container 70 is used in the auxiliary capture mode to allow system 50 to continue trapping DPM while chamber 52 is being cleaned.

System 50 may be placed under the control of a control system such as control system 26. When the DPM loading of chamber 52 increases to a level at which cleaning is called for while the engine is running, valve 58 is operated to divert exhaust gas to chamber 54 so that no exhaust flows through chamber 52. The medium in chamber 54 now traps DPM.

When exhaust was flowing through only chamber 52, a valve system (not shown) prevented exhaust from flowing through pipes 72, 74. With valve 58 now diverting the flow through chamber 54, the valve system associated with pipes 72, 74 can be operated to allow air to flow into chamber 52 through pipe 74, to pass through medium 18 and exit the chamber through pipe 72.

Air from a compressed air source (not shown) is communicated to pipe 74. Container 70 is vented to atmosphere but has a filter medium covering the vent opening. When compressed air from the source is allowed to flow through chamber 52, trapped DPM entrains with the air flow and is conveyed through pipe 72 to the interior of container 70. The filter medium in container 70 allows the air to vent through the vent opening, but contains the DPM within the container interior. The cleaning process continues until stopped. Thereafter the valve system associated with the cleaning process can be operated to block flow through pipes 70, 72, and valve 58 can be operated to restore engine exhaust flow through chamber 52.

Should container 70 need to be emptied, suitable provision for emptying is made in its construction, and such emptying is preferably made when the system is cold and the engine is not running.

An advantage of system 50 is that it allows the principal DPF, i.e. chamber 52, to be cleaned while the engine continues running. To the extent that chamber 54 might need to be cleaned, a similar system could be associated with it.

While a presently preferred embodiment of the invention has been illustrated and described, it should be appreciated that principles of the invention are applicable to all embodiments that fall within the scope of the following claims.

What is claimed is:

1. A combustion engine comprising an exhaust system containing a particulate filter for trapping particulate matter in engine exhaust passing through the exhaust system, the particulate filter comprising a particulate trapping medium that is selectively operable to a relatively lesser porosity for trapping particulate matter in exhaust and to a relatively greater porosity for facilitating mechanical removal of trapped particulate matter, wherein the trapping medium comprises an expansible and contractible medium that in correlation with the selective application of an externally applied field to the medium is selectively operable to relatively lesser porosity when contracted and relatively greater porosity when expanded.

2. An engine as set forth in claim 1 including a device for selectively applying the field to the medium.

3. An engine as set forth in claim 2 wherein the device comprises an electromagnetic device for selectively applying a magnetic field to the medium to change porosity of the medium.

4. An engine as set forth in claim 2 wherein the device comprises an electric device for selectively applying an electric field to the medium to change porosity of the medium.

5. An engine as set forth in claim 1 wherein the medium is disposed within a casing having an exhaust inlet through which exhaust enters and an exhaust outlet through which exhaust exits, and further including a particulate collector communicated to the casing, a device for blocking exhaust from entering the exhaust inlet, a compressed air source for delivering compressed air into the casing and through the medium to the collector when the medium is expanded to relatively greater porosity and exhaust is being blocked from entering the exhaust inlet to cause particulates in the medium to entrain with compressed air moving through the medium, exit the casing and entering the collector, and to be collected in the collector.

6. An engine as set forth in claim 5 including a control system for indicating the amount of particulates in the medium and for adjusting the porosity of the medium as a function of the amount of particulates indicated.

7. An engine as set forth in claim 5 including an auxiliary particulate filter for trapping particulate matter in engine exhaust arranged in parallel flow relationship with the first-mentioned particulate filter, and a valve for directing exhaust flow away from the first-mentioned particulate filter to the auxiliary particulate filter.

8. A method for trapping particulate matter entrained in exhaust generated by a combustion engine and for removing trapped particulate matter, the method comprising:

when the engine is running, operating a particulate trapping medium to a condition of relatively lesser porosity to trap particulate matter in exhaust flowing through the medium, and when the medium needs to be mechanically cleaned, operating the particulate trapping medium to a condition of relatively greater porosity to allow trapped particulate matter to be removed mechanically from the medium, wherein the steps of operating the particulate trapping medium to the condition of relatively lesser porosity and to the condition of relatively greater porosity comprise selectively applying an external field to the medium.

9. A method as set forth in claim 8 wherein the step of selectively applying an external field to the medium comprises selectively applying a magnetic field to the medium.

10. A method as set forth in claim 9 wherein the step of selectively applying a magnetic field to the medium comprises selectively operating an electromagnetic device to selectively create opposite magnetic fields, one of which is effective to contract the medium to relatively lesser porosity and the other of which is effective to expand the medium to relatively greater porosity.

11. A method as set forth in claim 8 wherein the step of selectively applying an external field to the medium comprises selectively applying an electric field to the medium.

12. A method as set forth in claim 8 wherein the step of operating the particulate trapping medium to a condition of relatively greater porosity to allow trapped particulate matter to be removed from the medium is performed while the engine is not running.

13. A method as set forth in claim 8 wherein the step of operating the particulate trapping medium to a condition of relatively greater porosity to allow trapped particulate matter to be removed from the medium is performed while the engine is running and engine exhaust is being diverted to an auxiliary medium.

14. A method as set forth in claim 8 further comprising operating the particulate trapping medium to a condition of relatively greater porosity to allow trapped particulate matter to be removed from the medium, delivering compressed air from a compressed air source into a casing containing the medium, flowing the compressed air through the medium to entrain trapped particulates in the air flow, directing the air flow out of the casing to a collector, and collecting the entrained particulates in the collector.

15. A method as set forth in claim 14 comprising performing the steps of delivering compressed air from a compressed air source into a casing containing the medium, flowing the compressed air through the medium to entrain trapped particulates in the air flow, directing the air flow out of the casing to a collector, and collecting the entrained particulates in the collector while the engine is running and engine exhaust is being diverted to an auxiliary medium.

* * * * *